US007429555B2

(12) United States Patent
Scherer et al.

(10) Patent No.: US 7,429,555 B2
(45) Date of Patent: Sep. 30, 2008

(54) LUBRICATING GREASE WITH HIGH WATER RESISTANCE

(75) Inventors: Markus Scherer, Lebach (DE); Matthias Fischer, Worms (DE); Michael Mueller, Bensheim (DE); Bernard Kinker, Kintnersville, PA (US); Alexandra Pauker, Fischbachtal (DE)

(73) Assignee: Rohmax Additives GmbH, Darmstadt (DE)

( * ) Notice: Subject to any disclaimer, the term of this patent is extended or adjusted under 35 U.S.C. 154(b) by 398 days.

(21) Appl. No.: 10/834,861

(22) Filed: Apr. 30, 2004

(65) Prior Publication Data

US 2005/0245406 A1 Nov. 3, 2005

(51) Int. Cl.

| | |
|---|---|
| ***C10M 145/14*** | (2006.01) |
| ***C10M 169/06*** | (2006.01) |
| ***C08F 20/10*** | (2006.01) |
| ***C08F 220/10*** | (2006.01) |

(52) U.S. Cl. ..... 508/469; 508/519; 526/318.4; 526/328.5

(58) Field of Classification Search ..... 526/328.5, 526/318.4; 508/469, 519; 518/318.4, 328.5
See application file for complete search history.

(56) References Cited

U.S. PATENT DOCUMENTS

| | | | | |
|---|---|---|---|---|
| 2,577,706 | A * | 12/1951 | Hotten | 508/409 |
| 3,252,949 | A * | 5/1966 | Fields et al. | 526/264 |
| 4,357,249 | A * | 11/1982 | Mellor | 508/101 |
| 5,416,162 | A * | 5/1995 | Gore et al. | 525/79 |
| 2005/0148749 | A1 | 7/2005 | Scherer et al. | |
| 2005/0239937 | A1 | 10/2005 | Scherer et al. | |
| 2005/0245406 | A1 | 11/2005 | Scherer et al. | |
| 2005/0261143 | A1 | 11/2005 | Scherer et al. | |
| 2005/0267239 | A1 | 12/2005 | Scherer | |
| 2006/0189490 | A1 | 8/2006 | Dardin et al. | |

OTHER PUBLICATIONS

Imperator website, <http://www.imperator.eu/netkali/netkali.aspx?IdItem=38&IdDoc=36&IdLangue=2>, retrieved from the internet on Dec. 12, 2006.*
U.S. Appl. No. 11/587,988, filed Oct. 30, 2006, Fischer et al.
U.S. Appl. No. 10/593,082, filed Sep. 15, 206, Scherer et al.
U.S. Appl. No. 10/592,363, filed Sep. 11, 2006, Scherer et al.
U.S. Appl. No. 11/547,612, filed Oct. 4, 2006, Scherer et al.
U.S. Appl. No. 11/572,181, filed Jan. 16, 2007, Scherer et al.
U.S. Appl. No. 11/572,330, filed Jan. 19, 2007, Acker et al.

* cited by examiner

*Primary Examiner*—Glenn Caldarola
*Assistant Examiner*—Jim Goloboy
(74) *Attorney, Agent, or Firm*—Oblon, Spivak, McClelland, Maier & Neustadt, P.C.

(57) ABSTRACT

The present invention relates to lubricating greases comprising at least one thickening agent and at least one lubricating oil, wherein the lubricating grease contains at least one polymeric structure improver that can be obtained by polymerization of monomer compositions, which are composed of a) 0 to 40 wt %, relative to the weight of the monomer compositions for synthesis of the polymeric structure improvers, of at least one (meth)acrylate of formula (I)

(I)

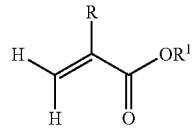

in which R represents hydrogen or methyl, $R^1$ denotes a straight-chain or branched alkyl moiety having 1 to 5 carbon atoms, b) 40 to 99.99 wt %, relative to the weight of the monomer compositions for synthesis of the polymeric structure improvers, of at least one (meth)acrylate of formula (II)

(II)

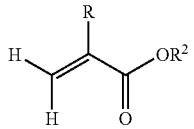

in which R represents hydrogen or methyl, $R^2$ denotes a straight-chain or branched alkyl moiety having 6 to 30 carbon atoms, c) 0.01 to 20 wt %, relative to the weight of the monomer compositions for synthesis of the polymeric structure improvers, of monomers containing acid groups or salts thereof, d) 0 to 59.99 wt %, relative to the weight of the monomer compositions for synthesis of the polymeric structure improvers, of comonomer.

17 Claims, No Drawings

LUBRICATING GREASE WITH HIGH WATER RESISTANCE

The present invention relates to a lubricating grease with high water resistance.

Lubricating greases are known in themselves and are used for numerous purposes. Lubricating greases, also referred to as "greases" hereinafter, are solid to semisolid substances produced by dispersion of a thickening agent in a liquid lubricant. Other accessory substances (additives) that impart special properties may also be present.

The basic consistency of a grease is determined by the combination of base liquid and thickening agent. The base liquid is usually a base oil that is common in the lubricant industry, such as a mineral oil, synthetic oil or vegetable oil.

Very often, but not exclusively, metal soaps are used as thickening agents. More infrequently, complex metal soaps, organically modified clay (bentonite) or polyurea are also used. From the physical viewpoint, the thickening agents form the solid phase of the dispersion and thus, along with the base oil, are deciding factors for the physical and mechanical properties of the grease, such as low-temperature behavior, water resistance, dropping point or oil-repelling behavior. The different combinations of base oil and thickening agent are known to the experts and they determine the area of use of the grease in technical application.

Besides the known thickening agents, polymers have also been used more frequently in recent years. Besides increasing the viscosity of the base oil (by acting as thickener), these often also lead to a change in structure of the inorganic thickening agent (by acting as structure modifiers). The effect of polymers as thickeners or as viscosity-index improvers has already been long established and is prior art in the lubricant industry in the case of base oils, such as mineral oils, synthetic oils or vegetable oils. The use of polymers and their effect in greases is relatively new, however, and is documented by only a few examples from the literature.

U.S. Pat. No. 3,476,532 (Hartman, 4 Nov. 1969) describes metal-containing complexes of oxidized polyethylene containing functional oxygen groups, such as carbonyl, carboxyl or hydroxy groups. The material can be used to produce compositions resembling lubricating greases. The composition comprises a mixture of oxidized polyethylene and a complexing agent selected from at least divalent metal salts, fatty acids and metal complexes.

U.S. Pat. No. 3,705,853 (Fau et al., 23 Sep. 1970) describes a lubricating grease comprising a paraffinic mineral oil, a thickening agent in the form of a calcium complex soap and an organic terpolymer composed of 65% of ethylene, 5% of ester comonomer and 0.01 to 3% of acid-containing comonomer having a melt index of between 0.5 and 200. The greases have better water resistance, as measured with the water-washout test according to ASTM D 1264.

U.S. Pat. No. 4,877,557 (Kaneshige et al., 31 Oct. 1989) describes a lubricant composition containing a synthetic lubricating oil, an anti-wear additive and a liquid, modified copolymer of ethylene and alpha-olefin having a number-average molecular weight of between 300 and 12000 g/mol.

U.S. Pat. No. 5,116,522 (Brown et al., 23 Aug. 1989) describes a lubricant composition comprising ethylene copolymers, a lubricating oil, a thickening agent and a viscosity-index improver. The ethylene copolymer is a polymer of isobutylene or a copolymer of ethylene, butylene or isobutylene with a C3 to C30 olefin. As viscosity-index improvers there are used copolymers composed of 60 to 90% of ethylene and 40 to 10% of vinyl acetate, alkyl acrylates or alkyl methacrylates. The composition has very good high-temperature adherence and low-temperature softening.

European Patent 806459 and U.S. Pat. No. 5,858,934 (Wiggins et al., 8 May 1996) describe an improved biodegradable lubricating-grease composition composed of a base oil having a natural basis or a synthetic triglyceride basis, a performance additive composed of an alkylphenol, a benzotriazole or of an aromatic amine, and a thickening agent, which is the reaction product of a metal-base material and a carboxylic acid or the esters thereof. In addition, the lubricating grease can also contain viscosity modifiers, pour-point improvers or combinations of the two. The nature of the viscosity modifiers or of the pour-point improver is not discussed in further detail.

U.S. Pat. No. 6,300,288 (Curtis et al., 31 Mar. 1994) describes a lubricating grease composed of an oil having a viscosity typical of a lubricant, a polymer modified with an acid functionality and composed of an $\alpha$-olefin/diene copolymer or of a hydrogenated $\alpha$-olefin/diene copolymer, a metallic species capable of interacting with the acid functionality of the polymer to establish an association between the acid groups, and a co-thickening agent. The lubricating grease has improved rheological properties. The co-thickening agent and the metallic species can together form a thickened hyperbasic material, and in special cases even a hyperbasic carboxylate.

In general, the use of nonfunctionalized, purely polyolefinic polymers has been described adequately in the literature. For example, polyisobutylenes (PIBs) are described in Tribol. Schmierungstech. (1995), 42 (2), 92-96; straight-chain, branched and partly branched polyethylenes; isotactic polypropylenes, poly-1-butenes and poly(4-methyl-1-pentenes) are described in J. Synth. Lubric. 4 (1987).

Heretofore the use of reactively modified copolymers based on olefin copolymers (OCPs) has been limited to a few examples. It is described in NLGI Spokesman, Vol. 59, No.10, Feb. 1999, among other publications.

The use of polyalkylacrylates and polyalkylmethacrylates (PAMAs) as viscosity-index improvers and pour-point improvers is known in the literature and in engineering (Wilfried J. Bartz et al., Lubricating Greases, expert-Verl., 2000, ISBN 3-8169-1533-7; Wilfried J. Bartz et al., Additives for Lubricants, expert-Verl., 1994, ISBN 3-8169-0916-7).

According to the prior art explained in the foregoing, certain physical parameters such as Theological properties or the water resistance of the greases are improved by the addition of polymers to lubricating greases. On the other hand, it is evident that a permanent need exists to improve these properties still further. In particular, a better properties profile must be achieved. However, the improvement of one property, such as water resistance, must not be associated with an excessive deterioration of other properties, such as the ease of handling or the homogeneity.

In particular, the lubricating greases must have particularly high water resistance, excellent consistency and great homogeneity.

A further object may be seen in providing lubricating greases with improved temperature properties. In particular, the properties at low temperatures must be improved. Furthermore, the lubricating greases should be usable over a particularly broad temperature range.

It was therefore an object of the present invention to provide a lubricating grease with particularly great homogeneity.

Furthermore, it should be possible to produce the lubricating greases inexpensively. For this purpose production should be possible on a large industrial scale, without the need for new equipment or equipment of complex design.

These as well as other objects that are not explicitly named but can be derived or inferred without difficulty from the relationships discussed hereinabove are achieved by lubricating greases having all the features of claim 1. Expedient modifications of the inventive lubricating greases are protected in the dependent claims referred back to claim 1. As regards the method for production as well as the use, claim 14 show how the underlying object is achieved.

By the fact that a lubricating grease comprising at least one thickening agent and at least one lubricating oil contains at least one polymeric structure improver that can be obtained by polymerization of monomer compositions, which are composed of a) 0 to 40 wt %, relative to the weight of the monomer compositions for synthesis of the polymeric structure improvers, of at least one (meth)acrylate of formula (I)

(I)

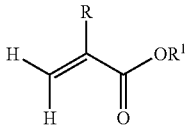

in which R represents hydrogen or methyl, $R^1$ denotes a straight-chain or branched alkyl moiety having 1 to 5 carbon atoms, b) 40 to 99.99 wt %, relative to the weight of the monomer compositions for synthesis of the polymeric structure improvers, of at least one (meth)acrylate of formula (II)

(II)

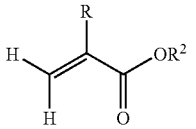

in which R represents hydrogen or methyl, $R^2$ denotes a straight-chain or branched alkyl moiety having 6 to 30 carbon atoms, c) 0.01 to 20 wt %, relative to the weight of the monomer compositions for synthesis of the polymeric structure improvers, of monomers containing acid groups or salts thereof, d) 0 to 59.99 wt %, relative to the weight of the monomer compositions for synthesis of the polymeric structure improvers, of comonomer, it is possible, in a manner that could not have been foreseen, to provide lubricating greases having improved properties.

At the same time, several further advantages can be achieved by the inventive lubricating greases. These include, among others:

the inventive lubricating greases exhibit very high water resistance.

The inventive lubricating greases exhibit very good homogeneity. Consequently, the consistency of the lubricating grease can be adjusted within a broad range.

The inventive lubricating greases exhibit very good temperature properties. Thus the inventive lubricating greases can be used over a particularly broad temperature range. Furthermore, the properties at low temperatures are excellent.

Furthermore, the inventive lubricating greases can be produced subsequently by modification of known lubricating greases, by adding a polymeric structure improver to a known grease. In this way it is possible in particular to avoid high storage costs. Furthermore, it will be possible to respond rapidly to customers' requests. Such subsequent modification alters the consistency of the lubricating grease only slightly, whereas it greatly increases the water resistance.

The lubricating greases of the present invention can be produced particularly easily and simply. Standard large industrial equipment can be used for this purpose.

Furthermore, it is possible in particular to use commercially available components in the method for production of the lubricating greases.

The inventive lubricating greases contain polymeric structure improvers. These polymers generally lead to an improvement of the water resistance. In this context, it is assumed that these polymers participate in physicochemical interactions with the thickening agents, such as the soap molecules, but this hypothesis is not to be construed as limitative.

Mixtures from which the polymeric structure improvers can be obtained may contain 0 to 40 wt %, especially 0.5 to 20 wt %, relative to the weight of the monomer compositions for synthesis of the polymeric structure improvers, of at least one (meth)acrylate of formula (I), (I)

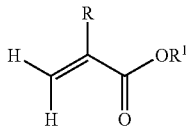

in which R represents hydrogen or methyl, $R^1$ denotes a straight-chain or branched alkyl moiety having 1 to 5 carbon atoms. The expression (meth)acrylates includes methacrylates and acrylates as well as mixtures of the two. These monomers are largely known. The alkyl moiety can be straight-chain, cyclic or branched.

Examples of components a) include (meth)acrylates derived from saturated alcohols, such as methyl(meth)acrylate, ethyl(meth)acrylate, n-propyl (meth)acrylate, isopropyl(meth)acrylate, n-butyl (meth) acrylate, tert-butyl(meth)acrylate, and pentyl(meth)acrylate;

cycloalkyl(meth)acrylates, such as cyclopentyl(meth)acrylate;

meth)acrylates derived from unsaturated alcohols, such as 2-propynyl (meth)acrylate, allyl(meth)acrylate and vinyl (meth)acrylate.

As a further constituent, the compositions to be polymerized for synthesis of preferred polymeric structure improvers contain 40 to 99.99 wt %, especially 55 to 95 wt %, relative to the weight of the monomer compositions for synthesis of the polymeric structure improvers, of at least one (meth)acrylate of formula (II)

(II)

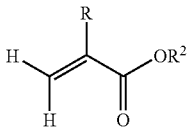

in which R represents hydrogen or methyl, $R^2$ denotes a straight-chain or branched alkyl moiety having 6 to 30 carbon atoms, This includes among other possibilities, (meth)acrylates derived from saturated alcohols, such as hexyl(meth)acrylate, 2-ethylhexyl(meth)acrylate, heptyl (meth)acrylate, 2-tert-butylheptyl(meth)acrylate, octyl (meth)acrylate, 3-isopropylheptyl(meth)acrylate, nonyl (meth)acrylate, decyl(meth)acrylate, undecyl(meth) acrylate, 5-methylundecyl(meth)acrylate, dodecyl(meth) acrylate, 2-methyldodecyl(meth)acrylate, tridecyl(meth) acrylate, 5-methyltridecyl(meth)acrylate, tetradecyl (meth)acrylate, pentadecyl (meth)acrylate, hexadecyl (meth)acrylate, 2-methylhexadecyl(meth)acrylate, heptadecyl(meth)acrylate, 5-isopropylheptadecyl(meth) acrylate, 4-tert-butyloctadecyl (meth)acrylate, 5-ethyloctadecyl(meth)acrylate, 3-isopropyloctadecyl(meth)acrylate, octadecyl(meth)acrylate, nonadecyl (meth)acrylate, eicosyl(meth)acrylate, cetyleicosyl(meth)acrylate, stearyleicosyl (meth)acrylate, docosyl(meth)acrylate and/or eicosyltetratriacontyl (meth)acrylate;

cycloalkyl(meth)acrylates, such as 2,4,5-tri-t-butyl-3-vinylcyclohexyl (meth)acrylate, 2,3,4,5-tetra-t-butylcyclohexyl (meth)acrylate;

(meth)acrylates derived from unsaturated alcohols, such as oleyl(meth)acrylate;

cycloalkyl(meth)acrylates, such as 3-vinylcyclohexyl(meth) acrylate, cyclohexyl (meth)acrylate, bornyl(meth)acrylate.

The (meth)acrylates containing long-chain alcohol moieties, especially the compounds according to component (b), can be obtained, for example, by reacting (meth)acrylates and/or the corresponding acids with long-chain fatty alcohols, generally to obtain a mixture of esters, such as (meth) acrylates containing different long-chain alcohol moieties. Such fatty alcohols include, among others, Oxo Alcohol® 7911 and Oxo Alcohol® 7900, Oxo Alcohol® 1100 of Monsanto; Alphanol® 79 of ICI; Nafol® 1620, Alfol® 610 and Alfol® 810 of Sasol; Epal® 610 and Epal® 810 of Ethyl Corporation; Linevol® 79, Linevol® 911 and Dobanol® 25L of Shell AG; Lial 125 of Sasol, Dehydad® and Lorol® types of Cognis.

According to a particular aspect of the present invention, the mixture for synthesis of preferred polymeric structure improvers contains at least 60 wt %, preferably at least 70 wt %, relative to the weight of the monomer compositions for synthesis of the polymeric structure improvers, of monomers according to formula (II).

In general, the methacrylates are preferred over the acrylates.

According to a particular aspect of the present invention, mixtures of long-chain alkyl(meth)acrylates according to component b) are preferably used, wherein the mixtures contain at least one (meth)acrylate having 6 to 15 carbon atoms in the alcohol moiety as well as at least one (meth)acrylate having 16 to 30 carbon atoms in the alcohol moiety. Preferably the proportion of (meth)acrylates having 6 to 15 carbon atoms in the alcohol moiety ranges from 20 to 95 wt % relative to the weight of the monomer compositions for synthesis of the polymeric structure improvers. The proportion of (meth)acrylates having 16 to 30 carbon atoms in the alcohol moiety preferably ranges from 0.5 to 60 wt % relative to the weight of the monomer compositions for synthesis of the polymeric structure improvers.

Component c) of the composition to be used for synthesis of preferred polymeric structure improvers comprises in particular monomers containing acid groups or the salts thereof.

Preferred salts are in particular the alkali metal salts, such as the lithium, sodium and/or potassium salts; the alkaline earth salts, such as the calcium and/or barium salts, as well as the aluminum salts and the ammonium salts.

The proportion of component c) is generally 0.01 to 20 wt %, preferably 0.1 to 10 wt % and particularly preferably 0.5 to 5 wt % relative to the weight of the monomer compositions for synthesis of the polymeric structure improvers.

Monomers containing acid groups are familiar to those skilled in the art. They can often be represented by formula (III)

(III)

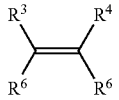

in which $R^3$ and $R^4$ are selected independently from the group comprising hydrogen, halogens, CN, straight-chain or branched alkyl groups having 1 to 20, preferably 1 to 6 and particularly preferably 1 to 4 carbon atoms, which alkyl groups may be substituted with 1 to (2n+1) halogen atoms, where n is the number of carbon atoms of the alkyl group (example: $CF_3$), α,β-unsaturated straight-chain or branched alkenyl or alkynyl groups having 2 to 10, preferably 2 to 6 and particularly preferably 2 to 4 carbon atoms, which alkenyl or alkynyl groups may be substituted with 1 to (2n −1) halogen atoms, preferably chlorine, where n is the number of carbon atoms of the alkyl group (example: $CH_2{=}CCl{-}$), cycloalkyl groups having 3 to 8 carbon atoms, which cycloalkyl groups may be substituted with 1 to (2n−1) halogen atoms, preferably chlorine, where n is the number of carbon atoms of the cycloalkyl group; aryl groups having 6 to 24 carbon atoms, which aryl groups may be substituted with 1 to (2n−1) halogen atoms, preferably chlorine, and/or with alkyl groups having 1 to 6 carbon atoms, where n is the number of carbon atoms of the aryl group; $COOR^7$, $-SO_3R^7$ and/or $PO_3R^7{}_2$, in which $R^7$ independently is hydrogen, an alkali metal, an alkaline earth and/or aluminum, an ammonium group having up to 20 carbon atoms or an alkyl group having 1 to 40 carbon atoms;

$R^5$ and $R^6$ are selected independently from the group comprising hydrogen, halogen (preferably fluorine or chlorine), alkyl groups having 1 to 6 carbon atoms and $COOR^7$, $-SO_3R^7$ and/or $PO_3R^7{}_2$, in which $R^7$ is independently hydrogen, an alkali metal, an ammonium group having up to 20 carbon atoms or an alkyl group having 1 to 40 carbon atoms, in which $R^7$ is hydrogen, an alkali metal, an alkaline earth and/or aluminum or an alkyl group having up to 40 carbon atoms, or $R^5$ and $R^6$ together can form a group of the formula $(CH_2)_{n'}$, which can be substituted with 1 to 2n' halogen atoms or $C_1$ to $C_4$ alkyl groups, or can form the formula C(=O)—Y—C(=O), wherein n' can be from 2 to 6, preferably 3 or 4 and Y can be $NR^8$, S or O, preferably 0, wherein $R^8$ is hydrogen, straight-chain or branched alkyl or aryl groups having 1 to 20 carbon atoms; wherein at least 2 of the moieties $R^3$, $R^4$, $R^5$ and $R^6$ are hydrogen or halogen and at least one of the moieties $R^3$, $R^4$, $R^5$ and $R^6$ is at least a group of the formula —COOM, —$SO_3M$ and/or $PO_3M_2$, in which M independently represents hydrogen, an alkali metal, an alkaline earth and/or aluminum.

These compounds can generally be copolymerized with the monomers according to components a), b) and d). They include, among other compounds, ethylenically unsaturated compounds, such as vinylsulfonic acid, vinylphosphonic acid, acrylic acid, methacrylic acid, fumaric acid, monoesters of fumaric acid, wherein the alcohol moiety can generally contain 1 to 30 carbon atoms, maleic acid, monoesters of maleic acid, wherein the alcohol moiety can generally contain 1 to 30 carbon atoms, vinylbenzoic acid and sulfonated styrenes, such as styrenesulfonic acid. The salts derived from these acids, especially the alkali metal, alkaline earth and/or aluminum salts, can also be used.

Component d) of the composition to be used for synthesis of preferred polymeric structure improvers comprises in particular ethylenically unsaturated monomers, which can be copolymerized with the monomers according to components a) to c).

Especially suitable, however, are comonomers for polymerization according to the present invention that correspond to the formula:

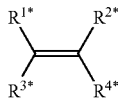

in which $R^{1*}$ and $R^{2*}$ are selected independently from the group comprising hydrogen, halogens, CN, straight-chain or branched alkyl groups having 1 to 20, preferably 1 to 6 and particularly preferably 1 to 4 carbon atoms, which alkyl groups may be substituted with 1 to (2n+1) halogen atoms, where n is the number of carbon atoms of the alkyl group (example: $CF_3$), α,β-unsaturated straight-chain or branched alkenyl or alkynyl groups having 2 to 10, preferably 2 to 6 and particularly preferably 2 to 4 carbon atoms, which alkenyl or alkynyl groups may be substituted with 1 to (2n−1) halogen atoms, preferably chlorine, where n is the number of carbon atoms of the alkyl group (example: $CH_2$=CCl—), cycloalkyl groups having 3 to 8 carbon atoms, which cycloalkyl groups may be substituted with 1 to (2n−1) halogen atoms, preferably chlorine, where n is the number of carbon atoms of the cycloalkyl group; aryl groups having 6 to 24 carbon atoms, which aryl groups may be substituted with 1 to (2n−1) halogen atoms, preferably chlorine, and/or with alkyl groups having 1 to 6 carbon atoms, where n is the number of carbon atoms of the aryl group; $COOR^{9*}$, in which $R^{9*}$ is an alkyl group having 1 to 40 carbon atoms; $C(=Y^*)R^{5*}$, $C(=Y)NR^{6*}$, $R^{7*}$, $Y^*C(=Y^*)R^{5*}$, $SOR^{5*}$, $SO_2R^{5*}$, $OSO_2R^{5*}$, $NR^{8*}SO_2R^{5*}$, $PR^{5*}_2$, $P(=Y^*)R^{5*}_2$, $Y^*PR^{5*}_2$, $Y^*P(=Y^*)R^{5*}_2$, $NR^{8*}_2$, which can be quaternized with an additional $R^{8*}$, aryl or heterocyclyl group, wherein Y* can be $NR^{8*}$, S or O, preferably 0;

$R^{5*}$ is an alkyl group having 1 to 20 carbon atoms, an alkylthio group having 1 to 20 carbon atoms, $OR^{10*}$ ($R^{10*}$ is hydrogen or an alkali metal), an alkoxy group having 1 to 20 carbon atoms, an aryloxy group or a heterocyclyloxy group; $R^{6*}$ and $R^{7*}$ are independently hydrogen or an alkyl groups having 1 to 20 carbon atoms, or $R^{6*}$ and $R^{7*}$ together can form an alkenyl group having 2 to 7, preferably 2 to 5 carbon atoms, wherein they comprise a ring with 3 to 8 members, preferably 3 to 6 members, and $R^{8*}$ is hydrogen, straight-chain or branched alkyl or aryl groups having 1 to 20 carbon atoms;

$R^{3*}$ and $R^{4*}$ are selected independently from the group comprising hydrogen, halogen (preferably fluorine or chlorine), alkyl groups having 1 to 6 carbon atoms and $COOR^{9*}$, in which $R^{9*}$ is an alkyl group having 1 to 40 carbon atoms, or $R^{3'}$ and $R^{4*}$ together can form a group of the formula $(CH_2)_{n'}$, which can be substituted with 1 to 2n' halogen atoms or $C_1$ to $C_4$ alkyl groups, or can form the formula C(=O)—Y*—C(=O), wherein n' can be from 2 to 6, preferably 3 or 4 and Y* is as defined hereinabove;

and wherein at least 2 of the groups $R^{1*}$, $R^{2*}$, $R^{3*}$ and $R^{4*}$ are hydrogen or halogen.

These include, among others:

aryl(meth)acrylates, such as benzyl methacrylate or phenyl methacrylate, wherein the respective aryl groups can be unsubstituted or can have up to four substituents;

methacrylates of halogenated alcohols, such as 2,3-dibromopropyl methacrylate, 4-bromophenyl methacrylate, 1,3-dichloro-2-propyl methacrylate, 2-bromoethyl methacrylate, 2-iodoethyl methacrylate, chloromethyl methacrylate;

vinyl halides, such as vinyl chloride, vinyl fluoride, vinylidene chloride and vinylidene fluoride;

vinyl esters, such as vinyl acetate;

styrene, substituted styrenes containing an alkyl substituent in the side chain, such as α-methylstyrene and α-ethylstyrene, substituted styrenes containing an alkyl substituent in the ring, such as vinyltoluene and p-methylstyrene, halogenated styrenes, such as monochlorostyrenes, dichlorostyrenes, tribromostyrenes and tetrabromostyrenes;

heterocyclic vinyl compounds, such as 2-vinylpyridine, 3-vinylpyridine, 2-methyl-5-vinylpyridine, 3-ethyl-4-vinylpyridine, 2,3-dimethyl-5-vinylpyridine, vinylpyrimidine, vinylpiperidine, 9-vinylcarbazole, 3-vinylcarbazole, 4-vinylcarbazole, 1-vinylimidazole, 2-methyl-1-vinylimidazole, N-vinylpyrrolidone, 2-vinylpyrrolidone, N-vinylpyrrolidine, 3-vinylpyrrolidine, N-vinylcaprolactam, N-vinylbutyrolactam, vinyloxolane, vinylfuran, vinylthiophene, vinylthiolane, vinylthiazoles and hydrogenated vinylthiazoles, vinyloxazoles and hydrogenated vinyloxazoles;

vinyl and isoprenyl ethers;

maleic acid derivatives, such as the diesters of maleic acid, wherein the alcohol moiety can generally contain 1 to 30 carbon atoms, maleic anhydride, methylmaleic anhydride, maleimide, methylmaleimide;

fumaric acid derivatives, such as the diesters of fumaric acid, wherein the alcohol moiety can generally contain 1 to 30 carbon atoms;

dienes, such as divinylbenzene.

Particularly preferably, the compositions for synthesis of preferred structure improvers contain comonomers according to component d), which can be represented by formula (IV).

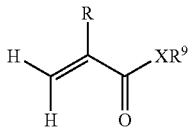

(IV)

in which R independently represents hydrogen or methyl, $R^9$ independently represents a group containing 2 to 1000 carbon atoms and having at least one hetero atom, X independently represents a sulfur or oxygen atom or a group of formula $NR^{10}$, in which $R^{10}$ independently represents hydrogen or a group having 1 to 20 carbon atoms and n represents an integral number larger than or equal to 3.

Moiety $R^9$ represents a group containing 2 to 1000, especially 2 to 100, preferably 2 to 20 carbon atoms. The expression "group containing 2 to 1000 carbon atoms" applies to moieties of organic compounds having 2 to 1000 carbon atoms. It includes aromatic and heteroaromatic groups as well as alkyl, cycloalkyl, alkoxy, cycloalkoxy, alkenyl, alkanoyl, alkoxycarbonyl groups as well as heteroaliphatic groups. These cited groups may be branched or non-branched. Furthermore, these groups can contain common substituents. Examples of substituents are straight-chain and branched alkyl groups having 1 to 6 carbon atoms, such as methyl, ethyl, propyl, butyl, pentyl, 2-methylbutyl or hexyl; cycloalkyl groups such as cyclopentyl and cyclohexyl; aromatic groups such as phenyl or naphthyl; amino groups, ether groups, ester groups and halides.

According to the invention, aromatic groups denote moieties of mononuclear or polynuclear aromatic compounds having preferably 6 to 20, especially 6 to 12 carbon atoms. Heteroaromatic groups apply to aryl groups in which at least one CH group is replaced by N and/or at least two neighboring CH groups are replaced by S, NH or O, wherein these heteroaromatic groups have 3 to 19 carbon atoms.

Aromatic or heteroaromatic groups preferred according to the invention are derived from benzene, naphthalene, biphenyl, diphenyl ether, diphenylmethane, diphenyldimethylmethane, bisphenone, diphenylsulfone, thiophene, furan, pyrrole, thiazole, oxazole, imidazole, isothiazole, isoxazole, pyrazole, 1,3,4-oxadiazole, 2,5-diphenyl-1,3,4-oxadiazole, 1,3,4-thiadiazole, 1,3,4-triazole, 2,5-diphenyl-1,3,4-triazole, 1,2,5-triphenyl-1,3,4-triazole, 1,2,4-oxadiazole, 1,2,4-thiadiazole, 1,2,4-triazole, 1,2,3-triazole, 1,2,3,4-tetrazole, benzo[b]thiophene, benzo[b]furan, indole, benzo[c] thiophene, benzo[c]furan, isoindole, benzoxazole, benzothiazole, benzimidazole, benzisoxazole, benzisothiazole, benzopyrazole, benzothiadiazole, benzotriazole, dibenzofuran, dibenzothiophene, carbazole, pyridine, bipyridine, pyrazine, pyrazole, pyrimidine, pyridazine, 1,3,5-triazine, 1,2,4-triazine, 1,2,4,5-triazine, tetrazine, quinoline, isoquinoline, quinoxaline, quinazoline, cinnoline, 1,8-naphthyridine, 1,5-naphthyridine, 1,6-naphthyridine, 1,7-naphthyridine, phthalazine, pyridopyrimidine, purine, pteridine or quinolizine, 4H-quinolizine, diphenyl ether, anthracene, benzopyrrole, benzooxathiadiazole, benzooxadiazole, benzopyridine, benzopyrazine, benzopyrazidine, benzopyrimidine, benzotriazine, indolizine, pyridopyridine, imidazopyrimidine, pyrazinopyrimidine, carbazole, aciridine, phenazine, benzoquinoline, phenoxazine, phenothiazine, acridizine, benzopteridine, phenanthroline and phenanthrene, which may also be substituted.

The preferred alkyl groups include the methyl, ethyl, propyl, isopropyl, 1-butyl, 2-butyl, 2-methylpropyl, tert-butyl, pentyl, 2-methylbutyl, 1,1-dimethylpropyl, hexyl, heptyl, octyl, 1,1,3,3-tetramethylbutyl, nonyl, 1-decyl, 2-decyl, undecyl, dodecyl, pentadecyl and eicosyl groups.

The preferred cycloalkyl groups include the cyclopropyl, cyclobutyl, cyclopentyl, cyclohexyl, cycloheptyl and cyclooctyl groups, which may be substituted with branched or non-branched alkyl groups.

The preferred alkenyl groups include the vinyl, allyl, 2-methyl-2-propenyl, 2-butenyl, 2-pentenyl, 2-decenyl and 2-eicosenyl groups.

The preferred alkynyl groups include the ethynyl, propargyl, 2-methyl-2-propynyl, 2-butynyl, 2-pentynyl and 2-decynyl groups.

The preferred alkanoyl groups include the formyl, acetyl, propionyl, 2-methylpropionyl, butyryl, valeroyl, pivaloyl, hexanoyl, decanoyl and dodecanoyl groups.

The preferred alkoxycarbonyl groups include the methoxycarbonyl, ethoxycarbonyl, propoxycarbonyl, butoxycarbonyl, tert-butoxycarbonyl, hexyloxycarbonyl, 2-methylhexyloxycarbonyl, decyloxycarbonyl or dodecyloxycarbonyl groups.

The preferred alkoxy groups include alkoxy groups whose hydrocarbon moiety is one of the preferred alkyl groups mentioned in the foregoing.

The preferred cycloalkoxy groups include cycloalkoxy groups whose hydrocarbon moiety is one of the preferred cycloalkyl groups mentioned in the foregoing.

The preferred heteroatoms contained in moiety $R^{10}$ include, among others, oxygen, nitrogen, sulfur, boron, silicon and phosphorus.

According to a preferred embodiment of the present invention, moiety $R^8$ in formula (IV) contains at least one group of the formula —OH or —$NR^{10}R^{10}$, in which $R^{10}$ is independently hydrogen or a group having 1 to 20 carbon atoms.

Preferably the group X in formula (IV) can be represented by the formula NH.

The ratio of the number of heteroatoms to that of carbon atoms in moiety $R^9$ of formula (IV) can range widely. Preferably this ratio ranges from 1:1 to 1:10, especially 1:1 to 1:5, and particularly preferably 1:2 to 1:4.

Moiety $R^9$ of formula (IV) contains 2 to 1000 carbon atoms. According to a particular aspect, moiety $R^9$ contains at most 10 carbon atoms.

The particularly preferred comonomers include, among others, hydroxyalkyl(meth)acrylates such as
3-hydroxypropyl methacrylate,
3,4-dihydroxybutyl methacrylate,
2-hydroxyethyl methacrylate,
2-hydroxypropyl methacrylate,
2,5-dimethyl-1,6-hexanediol (meth)acrylate,
1,10-decandiol (meth)acrylate;
carbonyl-containing methacrylates, such as
2-carboxyethyl methacrylate,
carboxymethyl methacrylate,
oxazolidinylethyl methacrylate,
N-(methacryloyloxy)formamide,
acetonyl methacrylate,
N-methacryloylmorpholine,
N-methacryloyl-2-pyrrolidinone,
N-(2-methacryloyloxyethyl)-2-pyrrolidinone,
N-(3-methacryloyloxypropy!)-2-pyrrolidinone,
N-(2-methacryloyloxypentadecyl)-2-pyrrolidinone,
N-(3-methacryloyloxyheptadecyl)-2-pyrrolidinone;
glycol dimethacrylates, such as 1,4-butanediol methacrylate,
2-butoxyethyl methacrylate, 2-ethoxyethoxymethyl methacrylate,
2-ethoxyethyl methacrylate,
methacrylates of ether alcohols, such as
tetrahydrofurfuryl methacrylate,
vinyloxyethoxyethyl methacrylate,
methoxyethoxyethyl methacrylate,
1-butoxypropyl methacrylate,
1-methyl-(2-vinyloxy)ethyl methacrylate,
cyclohexyloxymethyl methacrylate,
methoxymethoxyethyl methacrylate,
benzyloxymethyl methacrylate,
furfuryl methacrylate,
2-butoxyethyl methacrylate,
2-ethoxyethoxymethyl methacrylate,
2-ethoxyethyl methacrylate,
allyloxymethyl methacrylate,
1-ethoxybutyl methacrylate,
methoxymethyl methacrylate,
1-ethoxyethyl methacrylate,
ethoxymethyl methacrylate and ethoxylated (meth)acrylates, which preferably contain 1 to 20, especially 2 to 8 ethoxy groups;
aminoalkyl(meth)acrylates and aminoalkyl(meth)acrylate amides, such as N-(3-dimethylaminopropyl)methacrylamide,
dimethylaminopropyl methacrylate,
3-diethylaminopentyl methacrylate,
3-dibutylaminohexadecyl(meth)acrylate;
nitriles of (meth)acrylic acid and other nitrogen-containing methacrylates, such as
N-(methacryloyloxyethyl)diisobutylketimine,
N-(methacryloyloxyethyl)dihexadecylketimine,
methacryloylamindoacetonitrile,
2-methacryloyloxyethylmethylcyanamide,
cyanomethyl methacrylate,
heterocyclic (meth)acrylates, such as 2-(1-imidazolyl)ethyl (meth)acrylate,
2-(4-morpholinyl)ethyl(meth)acrylate and 1-(2-methacryloyloxyethyl)-2-pyrrolidone;
oxiranyl methacrylates, such as
2,3-epoxybutyl methacrylate,
3,4-epoxybutyl methacrylate,
10,11-epoxyundecyl methacrylate,
2,3-epoxycyclohexyl methacrylate,
10,11-epoxyhexadecyl methacrylate;
glycidyl methacrylate,
sulfur-containing methacrylates, such as
ethylsulfinylethyl methacrylate,
4-thiocyanatobutyl methacrylate,
ethylsulfonylethyl methacrylate,
thiocyanatomethyl methacrylate,
methylsulfinylmethyl methacrylate,
bis(methacryloyloxyethyl)sulfide;
methacrylates that contain phosphorus, boron and/or silicon, such as
2-(dimethylphosphato)propyl methacrylate,
2-(ethylenephosphito)propyl methacrylate,
dimethylphosphinomethyl methacrylate,
dimethylphosphonoethyl methacrylate,
diethylmethacryloyl phosphonate,
dipropylmethacryloyl phosphate, 2-(dibutylphosphono)ethyl methacrylate,
2,3-butylenemethacryloylethyl borate,
methyldiethoxymethacryloylethoxysilane,
diethylphosphatoethyl methacrylate.

These monomers can be used individually or as mixtures. The ethoxylated (meth)acrylates can be obtained, for example, by transesterification of alkyl(meth)acrylates with ethoxylated alcohols, which in particular contain 1 to 20, especially 2 to 8 ethoxy groups. The hydrophobic moiety of the ethoxylated alcohols can contain preferably 1 to 40, especially 4 to 22 carbon atoms, and both straight-chain and branched alcohol moieties can be used. According to a further preferred embodiment, the ethoxylated (meth)acrylates contain an OH end group.

Examples of commercial ethoxylates that can be used for synthesis of ethoxylated (meth)acrylates include ethers of the Lutensol® A brands, especially Lutensol®αA 3 N, Lutensol® A 4 N, Lutensol® A 7 N and Lutensol®αA 8 N, ethers of the Lutensol® TO brands, especially Lutensol® TO 2, Lutensol® TO 3, Lutensol® TO 5, Lutensol® TO 6, Lutensol® TO 65, Lutensol® TO 69, Lutensol® TO 7, Lutensol® TO 79, Lutensol® 8 and Lutensol® 89, ethers of the Lutensol® AO brands, especially Lutensol® AO 3, Lutensol® AO 4, Lutensol® AO 5, Lutensol® AO 6, Lutensol® AO 7, Lutensol® AO 79, Lutensol® AO 8 and Lutensol® AO 89, ethers of the Lutensol® ON brands, especially Lutensol® ON 30, Lutensol® ON 50, Lutensol® ON 60, Lutensol® ON 65, Lutensol® ON 66, Lutensol® ON 70, Lutensol® ON 79 and Lutensol® ON 80, ethers of the Lutensol® XL brands, especially Lutensol® XL 300, Lutensol® XL 400, Lutensol® XL 500, Lutensol® XL 600, Lutensol® XL 700, Lutensol® XL 800, Lutensol® XL 900 and Lutensol® XL 1000, ethers of the Lutensol® AP brands, especially Lutensol® AP 6, Lutensol® AP 7, Lutensol® AP 8, Lutensol® AP 9, Lutensol® AP 10, Lutensol® AP 14 and Lutensol® AP 20, ethers of the IMBENTIN® brands, especially of the IMBENTIN® AG brands, of the IMBENTIN® U brands, of the IMBENTIN® C brands, of the IMBENTIN® T brands, of the IMBENTIN® OA brands, of the IMBENTIN® POA brands, of the IMBENTIN® N brands and of the IMBENTIN® O brands, as well as ethers of the Marlipal® brands, especially Marlipal® 1/7, Marlipal® 1012/6, Marlipal® 1618/1, Marlipal® 24/20, Marlipal® 24/30, Marlipal® 24/40, Marlipal® O13/20, Marlipal® O13/30, Marlipal® O13/40, Marlipal® O25/30, Marlipal® 025/70, Marlipal® O45/30, Marlipal® O45/40, Marlipal® O45/50, Marlipal® 045/70 and Marlipal® O45/80.

Of the foregoing, particularly preferred are aminoalkyl (meth)acrylates and aminoalkyl(meth)acrylamides, such as N-(3-dimethylaminopropyl) methacrylamide (DMAPMAM), and hydroxyalkyl(meth)acrylates, such as 2-hydroxyethyl methacrylate (HEMA).

Most particularly preferred mixtures for synthesis of the polymeric structure improvers contain methyl methacrylate, butyl methacrylate, lauryl methacrylate, stearyl methacrylate and/or styrene.

These components can be used individually or as mixtures.

The preferred polymeric structure improvers generally have a molecular weight in the range of 10,000 to 1,000,000 g/mol, preferably in the range of $15*10^3$ to $500*10^3$ g/mol and particularly preferably in the range of $20*10^3$ to $300*10^3$ g/mol, although these values are not to be construed as limitative. They relate to the weight-average molecular weight of the polydisperse polymers in the composition. This parameter can be determined by gel permeation chromatography in the known manner.

The synthesis of the polymeric structure improvers from the compositions described in the foregoing is known in itself. Thus these polymers can be obtained in particular by radical polymerization as well as by related methods, such as ATRP (atom transfer radical polymerization) or RAFT (reversible additional fragmentation chain transfer).

The customary free-radical polymerization is explained in Ullmanns Encyclopedia of Industrial Chemistry, Sixth Edition, among other sources. In general, a polymerization initiator is used for this purpose.

Such initiators include, among others, the azo initiators such as AIBN and 1,1-azobiscyclohexanecarbonitrile, which are largely known to those skilled in the art, as well as peroxy compounds, such as methyl ethyl ketone peroxide, acetylacetone peroxide, dilauryl peroxide, tert-butyl-per-2-ethyl hexanoate, ketone peroxide, tert-butyl peroctoate, methyl isobutyl ketone peroxide, cyclohexanone peroxide, dibenzoyl peroxide, tert-butyl peroxybenzoate, tert-butyl peroxyisopropylcarbonate, 2,5-bis(2-ethylhexanoylperoxy)-2,5-dimethylhexane, tert-butylperoxy-2-ethyl hexanoate, tert-butylperoxy-3,5,5-trimethyl hexanoate, dicumyl peroxide, 1,1-bis (tert-butylperoxy)cyclohexane, 1,1-bis(tert-butylperoxy)-3, 3,5-trimethylcyclohexane, cumyl hydroperoxide, tert-butyl hydroperoxide, bis(4-tert-butylcyclohexyl)peroxydicarbonate, mixtures of two or more of the foregoing compounds with one another as well as mixtures of the foregoing compounds with other compounds that have not been mentioned but which can also form radicals.

The ATRP method is known in itself. It is assumed that this is a "living" radical polymerization, and that the description of the mechanism is not to be construed as limitative. In this method, a transition metal compound is reacted with a compound that contains a transferable group of atoms. In the process, the transferable group of atoms is transferred to the transition metal compound, whereby the metal is oxidized. In this reaction, a radical is formed and becomes added to ethylenic groups. The transfer of the group of atoms to the transition metal compound is reversible, however, and so the group of atoms is transferred back to the growing polymer chain, whereby a controlled polymerization system is established. Accordingly, the polymer structure, the molecular weight and the molecular-weight distribution can be controlled.

This reaction process is described, for example, by J-S. Wang et al., J. Am. Chem. Soc., Vol. 117, pp. 5614-5615 (1995), and by Matyjaszewski, Macromolecules, Vol. 28, pp. 7901-7910 (1995). In addition, International Patent Applications WO 96/30421, 97/47661, 97/18247, 98/40415 and 99/10387 disclose variants of the ATRP method explained in the foregoing.

Furthermore, the inventive polymers can be obtained by RAFT methods. This method is explained in detail in, for example, WO 98/01478, to which express reference is made for the purposes of the disclosure.

The polymerization can be performed at normal pressure, reduced pressure or high pressure. The polymerization temperature also is not critical. In general, however, it falls within the range of −20° to 200° C., preferably 0° to 130° C. and particularly preferably 600 to 120° C.

The polymerization can be carried out with or without solvent. In this connection, the meaning of solvent is to be broadly understood.

Preferably, the polymerization is carried out in a nonpolar solvent. This type of solvent includes hydrocarbon solvents, or in other words aromatic solvents, such as toluene, benzene and xylene, and saturated hydrocarbons, such as cyclohexane, heptane, octane, nonane, decane and dodecane, which may also be used in branched form. These solvents can be used individually and also as mixtures. Particularly preferred solvents are mineral oils, natural oils and synthetic oils as well as mixtures thereof. Of the foregoing, mineral oils are quite particularly preferred.

The polymeric structure improvers can be statistical copolymers. Furthermore, these polymers can represent graft polymers and/or block copolymers.

According to a special aspect of the present invention, the polymeric structure improver can be obtained by graft polymerization, wherein a composition containing components a) to d) is polymerized on a graft base comprising an olefin copolymer (OCP) composed mainly of ethylene and propylene, and/or a hydrogenated copolymer (HSD) of dienes and styrene.

The polyolefin copolymers (OCP) used for this purpose are known in themselves. They are primarily polymers composed of ethylene, propylene, isoprene, butylenes and/or further olefins having 5 to 20 carbon atoms. Systems grafted with small quantities of oxygen-containing or nitrogen-containing monomers (such as 0.05 to 5 wt % of maleic anhydride) can also be used. The copolymers that contain diene components are generally hydrogenated in order to reduce the oxidation sensitivity as well as the cross-linking tendency of the polymers.

The molecular weight Mw generally ranges from 10,000 to 300,000, preferably from 50,000 to 150,000. Such olefin copolymers are described in, for example, German Unexamined Applications (DE-A) 1644941, 1769834, 1939037, 1963039 and 2059981.

Ethylene-propylene copolymers are particularly suitable for use. Terpolymers containing the known tercomponents such as ethylidene-norbornene (see Macromolecular Reviews, Vol. 10 (1975)) are also possible, but their tendency to cross-linking during the aging process must be taken into consideration. The distribution can be largely statistical, although sequence polymers containing ethylene blocks can also be advantageously employed. The ratio of the ethylene-propylene monomers is variable within certain limits. As the upper limit, approximately 75% can be set for ethylene and approximately 80% for propylene. Because of its tendency toward lower solubility in oil, polypropylene is already less suitable than ethylene-propylene copolymers. Besides polymers having mainly atactic propylene structure, polymers with more pronounced isotactic or syndiotactic propylene structure are also usable.

Such products are commercially available under trade names such as Dutral® CO 034, Dutral® CO 038, Dutral® CO 043, Dutral® CO 058, Buna® EPG 2050 or Buna® EPG 5050.

The hydrogenated styrene-diene copolymers (HSD) are also known. Such polymers are described in, for example German Patent 2156122. They are generally hydrogenated isoprene or butadiene-styrene copolymers. The ratio of diene to styrene preferably ranges from 2:1 to 1:2, and especially preferably is about 55:45. The molecular weight Mw generally ranges from 10,000 to 300,000, preferably 50,000 to 150,000. According to a special aspect of the present invention, the proportion of double bonds after hydrogenation is at most 15% and particularly preferably at most 5% relative to the number of double bonds before hydrogenation.

Hydrogenated styrene-diene copolymers can be obtained commercially under the trade names®SHELLVIS 50, 150, 200, 250 or 260.

The synthesis of the graft copolymers described in the foregoing—containing at least one HSD and/or OCP block as well as at least one block containing components a), b), c) and/or d) described in the foregoing—is known to those skilled in the art. For example, the synthesis can be achieved by solution polymerization. Such methods are described in German Patent A 1235491, Belgian Patent A 592880 and U.S. Pat. Nos. A 4,281,081, A 4,338,418 and A 4,290,025 among other sources.

The polymeric structure improver is present in the lubricating grease preferably in a proportion ranging from 0.1 to 10 wt %, especially preferably 0.5 to 5 wt % relative to the total weight.

The lubricating oils contained in the inventive lubricating greases include in particular mineral oils, synthetic oils and natural oils.

Mineral oils are known in themselves and commercially available. They are generally obtained from petroleum or crude oil by distillation and/or refining and if necessary further purification and conversion methods. The term mineral oil applies in particular to the higher-boiling fractions of crude oil or petroleum. In general, the boiling point of mineral oil is higher than 200° C., preferably higher than 300° C. at 5000 Pa. Production by low-temperature distillation of shale oil, coking of bituminous coal, distillation of lignite in the absence of air and hydrogenation of bituminous coal or lignite is also possible. To a small extent, mineral oils are also produced from raw materials of vegetable origin (such as jojoba, rape) or animal origin (such as neatsfoot oil). Accordingly, mineral oils have different proportions of aromatic, cyclic, branched and straight-chain hydrocarbons depending on their origin.

In general, a distinction is made between paraffin-base, naphthenic and aromatic fractions in crude oils or mineral oils. The term paraffin-base fraction applies to relatively long-chain or highly branched isoalkanes, and the term naphthenic fraction applies to cycloalkanes. Furthermore, depending on their origin and how they were converted, mineral oils contain different proportions of n-alkanes, isoalkanes with low degree of branching, monomethyl branched paraffins and compounds that contain heteroatoms, especially O, N and/or S, and that therefore have polar properties to a limited extent. Correlation is difficult, however, since individual alkane molecules can contain both long-chain branched groups and cycloalkane moieties as well as aromatic components. For the purposes of the present invention, a correlation can be established according to DIN 51378, for example. Polar fractions can also be determined according to ASTM D 2007. The proportion of n-alkanes in preferred mineral oils is less than 3 wt % and the proportion of compounds that contain O, N and/or S is less than 6 wt %. The proportion of aromatics and of monomethyl branched paraffins generally ranges from 0 to 40 wt %. According to one interesting aspect, mineral oil contains mainly napthenic and paraffin-base alkanes, which generally have more than 13 carbon atoms, preferably more than 18 and particularly preferably more than 20. The proportion of those compounds is generally ≧60 wt %, preferably ≧80 wt %, although these values are not to be construed as limitative. A preferred mineral oil contains 0.5 to 30 wt % of aromatic fractions, 15 to 40 wt % of naphthenic fractions, 35 to 80 wt % of paraffin-base fractions, up to 3 wt % of n-alkanes and 0.05 to 5 wt % of polar compounds, in each case relative to the total weight of the mineral oil.

An analysis of particularly preferred mineral oils by means of conventional methods such as urea separation and liquid chromatography on silica gel reveals, for example, the following constituents (in each case the percentage values are relative to the total weight of the respective mineral oil used):

n-alkanes having about 18 to 31 C atoms:

0.7 to 1.0%, slightly branched alkanes having 18 to 31 C atoms:

1.0 to 8.0%, aromatics having 14 to 32 C atoms:

0.4 to 10.7%, isoalkanes and cycloalkanes having 20 to 32 C atoms:

60.7 to 82.4%, polar compounds:

0.1 to 0.8%, loss:

6.9 to 19.4%.

Valuable hints regarding the analysis of mineral oils, together with a list of mineral oils having a different composition, can be found in, for example, Ullmanns Encyclopedia of Industrial Chemistry, 5$^{th}$ Edition on CD-ROM, 1997, under key word "lubricants and related products".

Synthetic oils contain, among other substances, organic esters, such as diesters and polyesters, polyalkylene glycols, polyethers, synthetic hydrocarbons, especially polyolefins, of which polyalphaolefins (PAO) are preferred, silicone oils and perfluoroalkyl ethers. They are usually somewhat more expensive than the mineral oils, but have advantages in terms of their performance capabilities.

Natural oils are animal or vegetable oils, such as neatsfoot oils or jojoba oils.

These lubricating oils can also be used as mixtures, and are often commercially available.

Preferably, the lubricating grease contains 69.9 to 98.9 wt %, especially 75 to 95 wt % of lubricating oil relative to the total weight.

The thickening agents contained in the inventive lubricating greases are known in themselves among those skilled in the art and can be obtained commercially. They are mentioned in, among other publications, Ullmanns Encyclopedia of Industrial Chemistry, Sixth Edition, Vol. 20, 2003, Wiley, ISBN 3-527-30385-5, in T Mang and W. Dresel, Lubricants and Lubrication, 2001, Wiley, ISBN 3-527-29536-4, and in Wilfried J. Bartz et al., Lubricating Greases, expert-Verl., 2000, ISBN 3-8169-1533-7. They include in particular soap thickeners, inorganic thickeners and polymeric thickeners.

The soap thickeners generally contain at least one metal component as well as at least one carboxylic acid anion component.

The usual metal components include in particular the alkali metals, such as lithium, sodium and potassium, the alkaline earths, such as calcium or barium, and aluminum.

The carboxylic acid anion component generally comprises anions derived from long-chain carboxylic acids, which often have 6 to 30 carbon atoms. They include in particular stearic acid, 12-hydroxystearic acid, octadecanoic acid, eicosanoic acid and hexadecanoic acid.

Furthermore, the carboxylic acid anion components can comprise anions derived from short-chain carboxylic acids having 1 to 6 carbon atoms or from aromatic carboxylic acids. Particular examples are acetic acid, propanoic acid and butanoic acid as well as benzoic acid.

The soap thickeners can be used as such in the method, in order to produce a dispersion having a grease structure. Furthermore, they can be produced in situ from the corresponding acids or derivatives thereof, such as the esters thereof, and from basic metal compounds.

The preferred structure has been explained hereinabove. As regards the esters, it can be stated that esters containing a short-chain alcohol moiety having 1 to 6 carbon atoms are preferred, such as the methyl, ethyl, propyl and butyl esters.

The preferred basic compounds include in particular the oxides, hydroxides and carbonates of the metals mentioned in the foregoing.

The preferred soap thickeners include, among others, lithium 12-hydroxystearate, lithium complex soaps, aluminum complex soaps and calcium complex soaps.

Furthermore, the basic compounds for production of the soaps can be added in an excess or deficit, in order to produce hypobasic or hyperbasic compounds.

Furthermore, inorganic thickening agents can be used. They include in particular organophilic clays, which may be derived from bentonite, and silica gel.

In addition, polymeric thickeners can also be used. These comprise polyureas as well as thermoplastic powders, such as polytetrafluoroethylene and fluoroethylenepropylene.

Preferably, the lubricating grease contains 0.01 to 30 wt %, particularly preferably 0.2 to 15 wt % and quite particularly preferably 0.5 to 10 wt % of thickener relative to the total weight.

The weight ratio of lubricating oil to thickening agent in the lubricating grease generally ranges from 100:1 to 100:30, preferably 100:2 to 100:25, especially 100:5 to 100:15.

Furthermore, the inventive lubricating grease can contain further additives and accessory substances.

Such additives include, among other substances, viscosity-index improvers, antioxidants, anti-aging agents, anti-wear agents, corrosion inhibitors, detergents, dispersants, EP additives, friction-reducing agents, dyes, aromas, metal deactivators and/or demulsifiers.

Preferably an inventive lubricating grease has a water resistance ranging from 1 to 50%, particularly preferably from 5 to 35%. The cone penetration of preferred lubricating greases ranges from 175 to 385 dmm, particularly preferably from 220 dmm to 340 dmm.

The water resistance can be determined according to ASTM D 4049. The cone penetration can be measured according to ASTM D 1403.

According to a special aspect of the present invention, special lubricating greases can be used at very low temperatures. Preferably, the lubricating greases can be used below a temperature of 0° C., particularly preferably of −10° C. Furthermore, preferred lubricating greases can also be used at high temperatures of at least 50° C., particularly preferably of at least 90° C.

The production of the inventive lubricating greases can be achieved by analogy with standard methods, which can be derived from the prior art cited hereinabove.

In general, the lubricating-grease structure or lubricating-grease matrix will be produced by physicochemical processes in a structure-forming phase. Various processes are then involved, such as aggregation of thickener crystallites, formation of soap micelles by addition and adsorption of base-oil molecules, melting of the soap micelles (=heating above the melting point of the soap molecules) and finally recrystallization of the soap molecules (=selective cooling).

In many cases, a metal soap is produced from precursor products in a first stage. In the reaction phase, metal-soap molecules are formed by reaction of the corresponding starting substance in the base oil. The metal-soap molecules then exist as fine crystals. This stage is optional, since it can be made unnecessary by choice of appropriate precursor compounds.

Addition of the polymeric structure improvers can take place before, during or after the structure-forming phase. For example, the polymeric structure improver can be synthesized firstly in a mineral oil. A thickener or precursor compounds for production of the thickener can then be added to the obtained mixture.

Furthermore, the polymeric structure improver can be added to a lubricating grease, for example, after the structure-forming phase. Preferably, the polymeric structure improver will be added in a composition that is liquid at 25° C. to a dispersion that has a grease structure.

The term "grease structure" is known among those skilled in the art. Such a structure can be characterized as sponge-like. This structure of the dispersion can be proved by microphotographs, for example, showing that the lubricating oil is held in a thickening agent.

The composition may represent both a dispersion and a solution. Accordingly, these compositions contain at least one liquid medium.

The particularly preferred media include in particular lubricating oils, which can also be used for production of the dispersion, which dispersion contains at least one thickening agent and at least one lubricating oil.

Liquid media for dispersing or dissolving the polymeric structure improvers described in the foregoing are known in themselves. These media should be compatible with the dispersion, which comprises at least one thickening agent and at least one lubricating oil. Compatibility here is understood as the miscibility of the medium with the dispersion comprising at least one thickening agent and at least one lubricating oil.

According to a special aspect of the present invention, the composition that is liquid at 25° C. and contains at least one polymeric structure improver has a viscosity at 25° C. ranging from 0.01 $mm^2/s$ to 100000 $mm^2/s$, preferably 0.1 $mm^2/s$ to 20000 $mm^2/s$ and particularly preferably 1 $mm^2/s$ to 10000 $mm^2/s$ according to DIN 51562.

The concentration of the polymeric structure improver in the composition that is liquid at 25° C. ranges mainly from 1 to 99 wt %, particularly preferably from 5 to 89 wt % and quite particularly preferably from 10 to 80 wt % relative to the total weight of the composition.

The ratio of the weight of dispersion to the weight of the composition that is liquid at 25° C. and that contains at least one polymeric structure improver ranges preferably from 100:1 to 1:1, particularly preferably from 50:1 to 5:1 and quite particularly preferably from 25:1 to 10:1.

The composition that is liquid at 25° C. can be added, among other times, during a mechanical phase following the structure-forming phase.

Furthermore, the composition that is liquid at 25° C. can be added to a finished lubricating grease after the mechanical phase. By virtue of this special aspect of the present invention, it is possible, for example, to produce a large quantity of a simple lubricating grease, which in a further step can be subsequently adapted to the special needs of the end customer by addition of the composition that is liquid at 25° C. and that can contain further additives. Hereby small quantities of special lubricating greases can be produced particularly economically.

According to a special embodiment of the present invention, the water resistance can be improved by at least 30%, particularly preferably by at least 50% and quite particularly preferably by at least 70% relative to the water resistance of the dispersion to which the composition that is liquid at 25° C. is added.

According to a special aspect of the present invention, the dispersion having the grease structure as well as the composition that is liquid at 25° C. is substantially biodegradable. Preferably this property is measured according to RAL ZU 64.

The composition that is liquid at 25° C. can be added to the dispersion having the grease structure by generally known methods. These methods include, among others, stirring, mixing, kneading, rolling and/or homogenizing.

The temperature at which the composition that is liquid at 25° C. is added to the dispersion having the grease structure is not critical in itself. At high temperature, the composition that is liquid at 25° C. can often be worked into the dispersion more easily. However, the grease structure must be stable at the addition temperature.

Preferably, the composition that is liquid at 25° C. is added to the dispersion having the grease structure at a temperature lower than the dropping point of the dispersion before addition of the liquid composition. The dropping point can be determined according to ASTM D 2265.

Particularly preferably, the composition that is liquid at 25° C. is added to the dispersion having the grease structure at a temperature at least 40° C. lower than, quite particularly preferably at least 60° C. lower than the dropping point of the dispersion before addition of the liquid composition.

According to a preferred variant of the inventive method, the composition that is liquid at 25° C. can be added at a temperature ranging from 0° C. to 75° C., especially from 25° C. to 70° C.

The invention will be explained in more detail hereinafter by examples and comparison examples, which are not to be construed as limiting the invention.

The following abbreviations will be used hereinafter:

KV 100, KV 40=kinematic viscosity, measured according to DIN 51562 at 100° C. and 40° C.

Typically, the polymer solutions described in the examples are measured in a 150 N measuring oil, and values in ( ) indicate the polymer concentration used. [η] denotes the limiting viscosity number, measured according to DIN ISO 16281, Part 6.

SYNTHESIS EXAMPLE 1

Synthesis of PAMA/Methacrylic Acid Polymers

In a 2-liter, four-necked flask equipped with stirrer, thermometer and reflux condenser, there are dissolved 6.1 g of methacrylic acid and 603.9 g of a C10-$C_{1-8}$ alkyl methacrylate in 499 g of 100 N oil, such as 100 SN of the Kuwait Petroleum Co. The solution is inerted by addition of 10 g of dry ice, and then the temperature is raised to 82° C. After this temperature has been reached, the polymerization is started by addition of 0.73 g of initiator (tert-butylper-2-ethylhexyl hexanoate). After 4 hours of reaction time, 1.21 g of initiator is added, followed after another 4 hours by 111 g of 100 N oil. The resulting polymer solution has a concentration of about 50%.

KV 100 (2% in 150 N oil): 10.11 $mm^2/s$

KV 40 (2% in 150 N oil): 58.43 $mm^2/s$

[η]136 $cm^3/g$

SYNTHESIS EXAMPLE 2

Synthesis of a PAMA Polymer without Acid Function

The synthesis is performed by analogy with Example 1

Batch polymerization, 82° C., 55% in 100 N oil 495.0 g of 100 N oil 605.0 g of C12-$C_{1-8}$ alkyl methacrylate 0.73 g of initiator (0.12%)

Reactivation step (after 4 h): 1.21 g of initiator (0.20%)

Dilution to 50% with 110.0 g of 100 N oil

KV 100 (2% in 150 N oil): 9.98 $mm^2/s$

KV 40 (2% in 150 N oil): 55.58 $mm^2/s$

[η] 127 $cm^3/g$

SYNTHESIS EXAMPLE 3

Synthesis of an NLGI Grade 2 Li Soap Grease (EG 2768)

In a 6-liter lubricating-grease autoclave reactor equipped with an oil-heated jacket and a mechanical planetary stirrer mechanism, there are added 272 g of hydrogenated castor oil (HCO, 181.6 mg KOH/g), 40 g of lithium hydroxide, 32 g of Vanlube NA (a diphenylamine of the Vanderbilt Co.), 32 g of Lubad 199 (a calcium salicylate of the Shell Co.) and 1440 g of HVI 650 oil of the Shell Co. as well as 1330 g of HVI 160 oil of the Shell Co. The reactor is closed and maintained for one hour at 100° C./100 rpm. Then the entire volume of resulting water of reaction is drained off and the mixture is heated to 210° C. After the maximum temperature has been reached, the mixture is cooled to 165° C. at a rate of 1° C./min while stirring at 200 rpm. Then the temperature is further lowered to 50° C. while stirring at 100 rpm. The reactor is opened and the resulting grease is homogenized at least 2 times using a three-roller mill and filled into a pail.

Physical Data:

Cone penetration (IP 50) unworked: 285 dmm, after 60 agitations 288 dmm (NLGI grade 2), after 100060 agitations: 317 dmm.

Dropping point (ASTM D566): 197.7° C.

Water washout (ASTM D 1264): 7.5%

Water spray-off (ASTM D 4049): 33.8%

EXAMPLE 1

In a blender (Kenwood Chef), 990 g of lubricating grease EG 2768 obtained according to Synthesis Example 3 (Li-soap base, with NLGI Classification of grade 2) was mixed at 60° C. with 10 g of a solution containing 50 wt % of polymers (with acid groups, obtained according to Synthesis Example 1) as well as a lubricating oil. The obtained mixture was then homogenized using a three-roller mill (Exact 50 of the Exact Apparatebau Co.). The properties of the modified lubricating grease were then determined.

In particular, there were measured for this purpose the dropping point according to ASTM D 566, the cone penetration according to ASTM D 217 and the water resistance according to ASTM D 4049. The data obtained are presented in Table 1.

COMPARISON EXAMPLE 1

Example 1 was substantially repeated, except that no solution was worked in. The data obtained are presented in Table 1.

COMPARISON EXAMPLE 2

Example 1 was substantially repeated, except that there was worked in a solution containing 50 wt % of polymers (without acid groups, obtained according to Synthesis Example 2) as well as a lubricating oil. The data obtained are presented in Table 1.

TABLE 1

| | Cone penetration after 60 agitations | Dropping point | Water resistance | Improvement compared with the starting grease |
|---|---|---|---|---|
| Example 1 | 291 | 197° C. | 20% | 41% |
| Comparison 1 | 288 | 198° C. | 34% | — |
| Comparison 2 | 279 | 198° C. | 27% | 21% |

EXAMPLE 2

In a blender (Kenwood Chef), 990 g of the lubricating grease Farmlub obtained from F&S Mannheim (Li-soap base, with NLGI Classification of grade 2) was mixed at 60° C. with 10 g of a solution containing 50 wt % of polymers (with acid groups, obtained according to Synthesis Example 1) as well as a lubricating oil. The obtained mixture was then homogenized using a three-roller mill (Exact 50 of the Exact Apparatebau Co.). The properties of the modified lubricating grease were then determined.

In particular, there were measured for this purpose the dropping point according to ASTM D 566, the cone penetration according to ASTM D 217 and the water resistance according to ASTM D 4049. The data obtained are presented in Table 2.

COMPARISON EXAMPLE 3

Example 2 was substantially repeated, except that no solution was worked in. The data obtained are presented in Table 2.

EXAMPLE 3

Example 2 was substantially repeated, except that there was worked in 40 g of the dispersion containing 50 wt % of polymers (with acid groups, obtained according to Synthesis Example 1) as well as a lubricating oil in 960 g of lubricating grease of F&S Mannheim. The data obtained are presented in Table 2.

COMPARISON EXAMPLE 4

Example 2 was substantially repeated, except that there was worked in 10 g of a solution containing 50 wt % of polymers (without acid groups, obtained according to Synthesis Example 2) as well as a lubricating oil. The data obtained are presented in Table 2.

COMPARISON EXAMPLE 5

Example 3 was substantially repeated, except that there was worked in 20 g of a solution containing 50 wt % of polymers (without acid groups, obtained according to Synthesis Example 2) as well as a lubricating oil in 980 g of grease of the F&S Co. The data obtained are presented in Table 2.

TABLE 2

| | Cone penetration after 60 agitations | Dropping point | Water resistance | Improvement compared with the starting grease |
|---|---|---|---|---|
| Example 2 | 291 | 182° C. | 20% | 68% |
| Comparison 3 | 251 | 186° C. | 62% | — |

TABLE 2-continued

| | Cone penetration after 60 agitations | Dropping point | Water resistance | Improvement compared with the starting grease |
|---|---|---|---|---|
| Example 3 | 294 | 185° C. | 11% | 82% |
| Comparison 4 | — | 188° C. | 40% | 35% |
| Comparison 5 | — | 183° C. | 28% | 55% |

What is claimed is:

1. A lubricating grease comprising at least one thickening agent, at least one lubricating oil, and at least one polymeric structure improver that can be obtained by polymerization of monomer compositions, which comprise a) 0 to 40 wt %, relative to the weight of the monomer compositions for synthesis of the polymeric structure improvers, of at least one (meth)acrylate of formula (I)

(I)

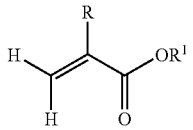

in which R represents hydrogen or methyl, $R^1$ denotes a straight-chain or branched alkyl moiety having 1 to 5 carbon atoms, b) 40 to 99.99 wt %, relative to the weight of the monomer compositions for synthesis of the polymeric structure improvers, of at least one (meth)acrylate of formula (II)

(II)

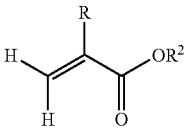

in which R represents hydrogen or methyl, $R^2$ denotes a straight-chain or branched alkyl moiety having 6 to 30 carbon atoms, c) 0.01 to 5 wt %, relative to the weight of the monomer compositions for synthesis of the polymeric structure improvers, of monomers containing acid groups or salts thereof, d) 0 to 59.99 wt %, relative to the weight of the monomer compositions for synthesis of the polymeric structure improvers, of comonomer.

2. A lubricating grease according to claim 1, wherein at least part of the monomers according to component c) contains at least one carboxyl group, at least one phosphonic acid group and/or at least one sulfonic acid group.

3. A lubricating grease according to claim 2, wherein component c) contains at least one monomer selected from the group comprising methacrylic acid and/or acrylic acid or salts thereof.

4. A lubricating grease according to claim 1, wherein the monomer composition contains 0.1 to 5 wt % relative to the weight of the monomer compositions for synthesis of the polymeric structure improvers, of monomers containing acid groups or salts thereof according to component c).

5. A lubricating grease according to claim 1, wherein the polymeric structure improver has a weight-average molecular weight ranging from 15,000 g/mol to 1,000,000 g/mol.

6. A lubricating grease according to claim 1, wherein the thickener is a soap thickener, an inorganic thickener and/or a polymeric organic thickener.

7. A lubricating grease according to claim 1, wherein the lubricating grease contains additives.

8. A lubricating grease according to claim 1, wherein the lubricating grease has a water resistance of 1 to 50%.

9. A lubricating grease according to claim 1, wherein the lubricating grease has a cone penetration ranging from 175 dmm to 385 dmm.

10. A lubricating grease according to claim 1, wherein the polymeric structure improver contains a block copolymer.

11. A lubricating grease according to claim 10, wherein the polymeric structure improver can be obtained by graft polymerization, wherein a composition comprising components a) to d) is polymerized on a graft base, which comprises an olefin copolymer (OCP) formed mainly from ethylene and propylene and/or a hydrogenated copolymer (HSD) of dienes and styrene.

12. A lubricating grease according to claim 1, wherein the lubricating grease contains 1 to 30 wt % of thickener.

13. A lubricating grease according to claim 1, wherein the lubricating grease contains 69.9 to 98.9 wt % of lubricating oil.

14. A method for production of lubricating grease, comprising producing a mixture comprising at least one thickening agent, at least one lubricating oil and a polymeric structure improver, which can be obtained by polymerization of monomer compositions, which comprise a) 0 to 40 wt %, relative to the weight of the monomer compositions for synthesis of the polymeric structure improvers, of one or more ethylenically unsaturated ester compounds of formula (I)

(I)

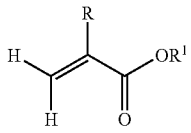

in which R represents hydrogen or methyl, $R^1$ denotes a straight-chain or branched alkyl moiety having 1 to 5 carbon atoms, b) 40 to 99.99 wt %, relative to the weight of the monomer compositions for synthesis of the polymeric structure improvers, of one or more ethylenically unsaturated ester compounds of formula (II)

(II)

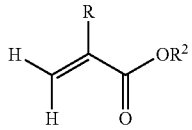

in which R represents hydrogen or methyl, $R^2$ denotes a straight-chain or branched alkyl moiety having 6 to 30 carbon atoms, c) 0.01 to 20 wt %, relative to the weight of the monomer compositions for synthesis of the polymeric structure improvers, of monomers containing acid groups or salts thereof, d) 0 to 59.99 wt %, relative to the weight of the monomer compositions for synthesis of the polymeric structure improvers, of comonomer.

15. A method according to claim 14, wherein the polymeric structure improver is added to a dispersion that has a grease structure and that comprises at least one thickening agent and at least one lubricating oil.

16. A method according to claim 14, wherein the polymeric structure improver is added in a composition that is liquid at 25° C. to the dispersion.

17. A method according to claim 15, wherein the polymeric structure improver is added in a composition that is liquid at 25° C. to the dispersion.

* * * * *